United States Patent [19]

Takimoto et al.

[11] 4,103,057

[45] Jul. 25, 1978

[54] DUPLICATE THERMOPLASTIC PLATES, MATRICES USEFUL THEREFOR AND METHODS OF MANUFACTURING THE SAME

[75] Inventors: Yasuyuki Takimoto, Takatsuki; Toshikazu Yoshikawa, Hirakata, both of Japan

[73] Assignee: Nippon Paint Company, Osaka, Japan

[21] Appl. No.: 699,213

[22] Filed: Jun. 24, 1976

Related U.S. Application Data

[63] Continuation-in-part of Ser. No. 458,855, Apr. 8, 1974, abandoned.

[30] Foreign Application Priority Data

Apr. 8, 1973 [JP] Japan ..... 48-39941

[51] Int. Cl.[2] ..... B41D 7/02

[52] U.S. Cl. ..... 428/156; 101/401.1; 101/401.2; 427/144; 428/172; 428/220; 428/323; 428/325; 428/330; 428/512; 428/521; 428/537; 204/159.2; 204/159.18

[58] Field of Search ..... 427/144; 428/156, 512, 428/521, 908, 220, 172, 402, 323, 325, 537, 330, 331, 144; 101/401.1, 401.2; 204/159.18, 159.2

[56] References Cited

U.S. PATENT DOCUMENTS

| | | | |
|---|---|---|---|
| 2,638,845 | 5/1953 | Perkins | 101/401.2 |
| 2,669,535 | 2/1954 | Orr | 428/156 |
| 3,004,871 | 10/1961 | Leavitt | 428/512 |
| 3,145,654 | 8/1964 | Johnson | 101/401.1 |
| 3,147,706 | 9/1964 | Antonio | 101/401.1 |
| 3,347,162 | 10/1967 | Braznell | 101/401.2 |
| 3,377,950 | 4/1968 | Squitieri | 101/401.2 |
| 3,408,437 | 10/1968 | Wheeler | 101/401.2 |
| 3,575,109 | 4/1971 | Wall | 101/401.1 |
| 3,615,469 | 10/1971 | Ramp | 101/401.1 |
| 3,812,078 | 5/1974 | Takimoto | 260/77.5 AB |

*Primary Examiner*—Ellis Robinson

*Attorney, Agent, or Firm*—Cook, Wetzel & Egan, Ltd.

[57] ABSTRACT

Duplicate thermoplastic plates are composed of a composition comprising a 1,2-polybutadiene having a crystallinity of about 10–30% and an intrinsic viscosity of greater than about 0.7. Matrices against which the duplicate thermoplastic plates are molded are formed of material containing said 1,2-PBD and a photoinitiator or a thermo-curable catalyst. The duplicate thermoplastic plates and matrices can give a high duration and reproducibility from an original pattern bearing design or image in relief, and they are molded with ease and in a great amount without difficulty. The use of the thermoplastic plates or matrices can provide a good releasability from the matrix against which the said plates are molded and from the original pattern against which the matrices are formed.

11 Claims, 1 Drawing Figure

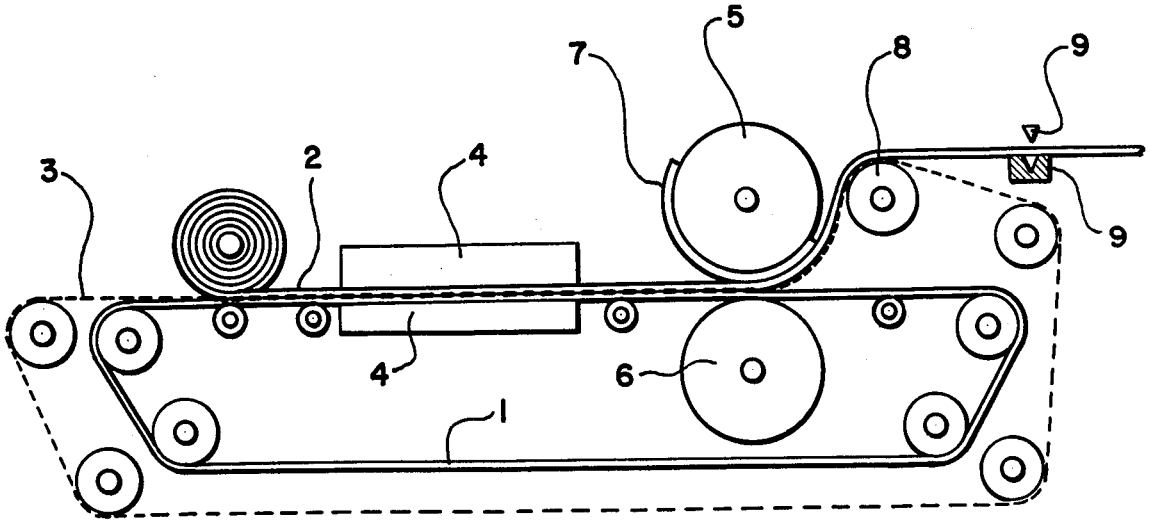
5
7
8
9
3
2
4
9
4
6
1

DUPLICATE THERMOPLASTIC PLATES, MATRICES USEFUL THEREFOR AND METHODS OF MANUFACTURING THE SAME

This application is a continuation-in-part application of our copending application Ser. No. 458,855 filed Apr. 8, 1974 now abandoned and entitled "Thermoplastic Duplication Plates And Process For Manufacture Thereof."

The present invention relates to duplicate thermoplastic plates and a method of manufacturing the duplicate thermoplastic plates. More particularly, the present invention relates to duplicate thermoplastic plates and a method of molding the plates against a thermoplastic matrix which is formed against an original relief pattern. This invention also includes a method of forming a thermoplastic matrix for use in manufacturing the duplicate plates and materials to be used therefor.

The method in accordance with the present invention lends itself particularly to the duplication of thermoplastic duplicate plates and matrix against an original pattern in large amounts, which may find use in printing and for decorative purposes as interior and outer building materials or displays and in various fields in which relief pattern may be employed.

In a field where a great number of copies of publication such as newspapers and magazines should be printed within a given short period of time, a number of printing plates are needed. Conventional methods of molding plural printing plates from an original plate involve transcription of relief pattern on duplicate printing plates by bringing moldable resinous materials in melt or soft state into contact with a metallic roll or flat metallic plate on the surface of which the relief pattern is formed. The relief pattern is generally formed by manual work such as chemical engraving. The manual work requires skilled workers for engraving the relief pattern. This involves quite a lot of labor and cost. The chemical engraving requires the employment of etching solutions which should face problems with pollution and working conditions. In these respects, conventional methods are not appropriate for this purpose. Accordingly, a simplified method capable of the duplication of plates from an original plate without the disadvantages of the conventional methods has long been demanded.

In a field where a high reproducibility is required such as in flexography, materials for flexographic plates are generally composed of a phenolic formaldehyde resin. The resin can work as the flexographic plate only after being thermally cured. The temperature at which said resin cures is so high that a photosensitive polymeric plate used as an original pattern from which the flexographic plates are formed may be deformed upon the application of such high temperatures over the flexographic plate superposed on the original pattern. This will impair its reproducibility of relief image on the original pattern sometimes to such an extent that the image cannot be reproduced. The flexographic plates prepared by such conventional materials are usually disposed by burning, but this may cause a problem because of the generation of a noxious gas. It has accordingly been demanded that a material for flexographic plates is provided which can reduce to a considerable extent or is substantially free from the disadvantages of conventional materials useful therefor.

In order to avoid the difficulties of conventional methods, the use of thermoplastic resins has been attempted. For example, U.S. Pat. No. 3,408,437 to Wheeler III et al. discloses thermoplastic printing plates by forming a thermoplastic matrix against an original pattern from a thermoplastic material having a heat distortion temperature at 264 p.s.i. of at least about 65° C. Wheeler III et al. use materials including polyarylene polyethers, polypropylene, acrylonitrile-butadiene-styrene (ABS) copolymers, polyhydroxyethers, impact polystyrene, styrene-acrylonitrile copolymers, polycarbonates, poly-4-methyl pentene-1, and the like. The use of these materials as matrix materials, however, requires high temperatures and pressures and long period of time for molding the matrix. Accordingly, improvements in these respects have been desired.

It is therefore an object of the present invention to provide duplicate thermoplastic plates which is molded against a matrix composed of materials capable of being molded at a relatively low temperature and pressure.

Another object of the present invention is to provide a method of the manufacture of the duplicate thermoplastic plates having properties as stated above.

A further object of the present invention is to provide a method of the manufacture of the duplicate thermoplastic plates by simplified procedures and with ease.

A still further object of the present invention is to provide a thermoplastic matrix material from which the matrix is formed against an original relief pattern. Another embodiment of the present invention is a method of molding the thermoplastic matrix against which the duplicate thermoplastic plates are molded.

A still further object of the present invention is to provide a material useful for flexographic plates which can reproduce a pattern with high precision.

Other objects, advantages and features of the present invention will become more apparent in the following description and from the appended claims and the accompanying drawing, in which:

The FIGURE is a schematic side elevational view illustrating an apparatus carrying out the present invention.

PREPARATION OF DUPLICATE PLATES

The duplicate thermoplastic plates of the present invention comprise a thermoplastic resin sheet prepared, for example, by extruding syndiotactic 1,2-polybutadiene singly or in a mixture with a thermoplastic resin. The duplicate thermoplastic plates may be prepared by contacting said sheet in a molten state with a matrix and molding the plate against the matrix, thereby transcribing the relief pattern thereof to said sheet.

The syndiotactic 1,2-polybutadiene (hereinafter called "1,2-PBD") to be used in the present invention has a crystallinity of about 10 to 30% and an intrinsic viscosity of higher than about 0.7, preferably from about 1.0 to 2.5 (when measured in toluene at 30° C). The 1,2-PBD is different from conventional 1,2-polybutadienes or rubbers in its nature and has properties analogous to those of plastices material. The 1,2-PBD possesses one of chemically reactive sites per one of segments which tend to become active for cross-linking upon exposure of ultraviolet light or by the application by heat. The cross-linking will occur in the following scheme:

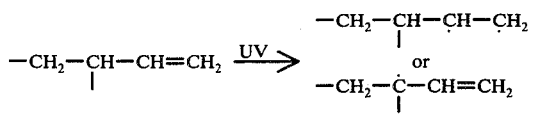

The thermoplastic resin which may be used in admixture with syndiotactic 1,2-PBD may be a homopolymer or copolymer of ethylene or propylene, polycarbonates, ABS resins or polyvinyl chloride. The resin to be used in the present invention may possess a melt index of from about 3 to 400 and preferably from about 10 to 200 and be employed in an amount of from about 1 to 500 parts by weight with respect to 100 parts by weight of the 1,2-PBD. The kind and amount of said resin may be chosen depending mainly upon the use of a resulting duplicate plate. The addition of said resin may function to increase the impact strength and decrease the elongation of the product.

PREPARATION OF MATRICES

The matrices in accordance with the present invention are formed against an original pattern. The matrices may be divided generally into plastic matrices and paper matrices of modified type.

The plastic matrices may be prepared, for example, by extruding a mixture containing 1,2-PBD as a major component and, when appropriate, a catalyst in the form of a sheet having a thickness preferably of about 1 to 10 mm. Each component may be mixed well with a heating roll or a pressure kneader. The temperature of mixing may range preferably from 100° to 130° C. Said mixture may be extrusion molded or compression molded into the form of sheet. With a plastic extruder, the mixing and molding can be effected simultaneously.

The modified paper matrix may be prepared, for example, by laminating a sheet of said mixture on a conventional paper matrix available for newspaper production or by coating said mixture over a paper matrix. The laminated paper matrix may be prepared by extruding said mixture into the form of a sheet and then superposing the sheet over a conventional paper matrix while the extruded sheet is in the molten state. The thickness of the sheet laminated thereon may preferably range from about 0.01 to 0.1 mm. The coating may be effected by dissolving said mixture in an organic solvent such as an aromatic solvent, e.g., toluene or xylene, in a concentration preferably of from about 10 to 20 percent by weight.

A composition containing derivatives of 1,2-PBD in the liquid state prepared by the anion polymerization method (e.g., Belgian Pat. No. 779,542) may also be employed as a substitute for a composition containing 1,2-PBD or in admixture therewith. The composition comprising the 1,2-PBD, however, is preferred as the matrix material from the standpoint of releasability from duplicate plates, matrix strength and ease of handling. It is accordingly to be understood that the term "1,2-PBD" in the sense used herein should include said 1,2-PBD derivative in the liquid state.

The catalyst which is mixed with the 1,2-PBD for preparing the plastic matrix in accordance with this invention may be a photoinitiator or a thermally curable substance. The photoinitiator is preferably employed where the cross-linking is effected by the application of light. And the thermally curable (thermo-curable) substance is preferably employed where the cross-linking is effected by the application of heat. If it is desired that the plastic matrices are recovered for further use, the addition of said catalyst may be avoidable.

The photoinitiator to be employed in the present invention can function to cross-link the 1,2-PBD by the application of light. It may include, for example, 5-nitroacenaphthene, anthracene, p-dinitrobenzene, m-dinitrobenzene, 2-chloro-4-nitroaniline, 9-anthranyl aldehyde, benzophenone, benzil, p,p'-tetramethyl diaminobenzophenone, benzanthrone, 1,2-benzanthraquinone, 1,2-naphthoquinone, 1,4-naphthoquinone, benzoin, benzoin methyl ether, benzoin isopropyl ether or benzoin n-butyl ether. The photoinitiator may be employed in an amount of from about 0.5 to 10 parts by weight with respect to 100 parts by weight of the 1,2-PBD.

The thermo-curable substance to be employed in the present invention may include a peroxide such as, for example, a dialkyl peroxide, e.g., dicumyl peroxide, 2,5-dimethyl-2,5-di-tert-butyl peroxyhexane or 2,5-dimethyl-2,5-di-tert-butyl peroxyhexene-3 or a hydroperoxide, e.g., di-tert-butyl hydroperoxide or cumenyl hydroperoxide. It may be used in an amount of from about 0.01 to 10 and preferably from about 0.05 to 5.0 parts by weight per 100 parts by weight of the 1,2-PBD. A filler may further be added for providing a good dimensional stability of the product and include, for example, a pigment, glass fibers or a coloring material. The pigment includes, for example, silica, calcium carbonate, clay or glass flakes. The pigment may be used in an amount of from about 10 to 200 parts by weight based on 100 parts by weight of the 1,2-PBD. The glass fibers may be glass chops having a fiber length of about 3 to 25 mm and may be used in an amount of about 5 to 50 parts by weight with respect to 100 parts by weight of the 1,2-PBD. The coloring material may be, for example, red iron oxide or carbon black and may be added in an amount of about 5 to 50 parts by weight per 100 parts by weight of the 1,2-PBD. The addition of the coloring agent may serve as facilitating proofreading as well as coloring the plates.

PREPARATION OF MATRICES AGAINST ORIGINAL PATTERN

The matrix materials are brought at ambient temperature or melt conditions into contact with an original pattern bearing the pattern to be transcribed to the matrix. Where the matrix material is composed of a resin composition containing 1,2-PBD alone, it is contacted at its melt state with the original pattern under elevated pressures. Where the surface-treated paper matrix is used as the matrix material, the contact thereof with the pattern may be effected at ambient temperatures and elevated pressures. The matrix may be worked up in conventional manner. For these purposes, a hydraulic press or a cylindrical press may be employed.

The original pattern against which the matrices are formed according to the present invention may be any pattern which is hardly affected adversely by temperatures and which can keep a plainness on its surface without warping during the transcribing process. Thus the original pattern may be photopolymer plates manufactured by the photo chemical process, metal engraving plates, electrotype plates, engraved plates, wooden plates, rock plates, and so on. Given particular conditions, an animal skin which otherwise is not applicable because of a low resistance to elevated temperatures may be used as the original pattern.

DUPLICATION OF PLATES AGAINST THE MATRIX

The duplication of thermoplastic plates may be effected against the matrix by superposing a thermoplastic sheet in a molten state on said matrix, said sheet being prepared by extruding a composition containing 1,2-PBD as a major component. The duplicate thermoplastic plates may be molded by calender, injection or compression molding.

1. Preparation of Duplicate Plates Useful as Printing Plates

The duplicate thermoplastic plates according to the present invention are particularly appropriate for use as printing plates, particularly for letterpress printing as a substitute for lead stereotypes customarily employed for this purpose. In this case, it is preferred to employ a combination of the duplicate plates, which are composed preferably of 1,2-PBD singly or in admixture with a thermoplastic resin compatible with the 1,2-PBD, with a photopolymer plates as the original pattern and a paper matrix of a type modified with the syndiotactic 1,2-polybutadiene sheet superposed thereon or of a type modified additionally with the thermo-curable silicones.

With a calender molding in a combination with the said preferred embodiments, the duplicate plates can be prepared in a way as efficient as conventional lead stereotypes can. The calender molding may be carried out with an apparatus as shown in FIGURE. One preferred embodiment of apparatus for carrying out the calender molding is disclosed in Japanese patent publication No. 12933/1973 published on Apr. 24, 1973. The apparatus comprises a metallic conveyor 1 by means of which a thermoplastic resin sheet 2 which is fed in the form of either a web of the rolled thermoplastic resin sheet or as cut sheet in a predetermined or desired length, is transported, while being superposed on a carrier 3, through a heating unit 4, the thermoplastic resin being allowed to melt during the passage thereof through the heating unit. The heating unit may be of a hot-air circulation type capable of heating the resin sheet at temperatures ranging from about 100° to 200° C, thereby providing the resin sheet with fluidility. The thermoplastic resin sheet emerging from the heating unit is subsequently passed through a clearance defined between a water-cooled press roll 5 and a water-cooled back-up roll 5, said press roll having a plastic or paper matrix 7 attached to the outer peripheral surface of said press roll. The press and back-up rolls are cooled at temperatures of about 5° to 10° C during the passage of said resin sheet through the clearance defined therebetween. Transcription of a relief pattern on the matrix is carried out during the passage of the thermoplastic resin sheet through the clearance of the press and back-up rolls, a complete plate having a transcribed relief image can be obtained upon separation from the matrix. The complete plate leaving the press and back-up rolls is further cooled by a cooling roll 8, thereby making the plate separate easily from the carrier, and it is then cut by a cutter 9 in a desired length.

The method in accordance with the present invention can alleviate the disadvantages which may arise with the use of the lead stereotypes. When the lead is casted, it generates a fume hazardous to working environments. The lead stereotypes are so heavy that they are difficult to handle. With the duplicate thermoplastic printing plates, the problems with carrying a heavy lead stereotype can be solved. The duplicate plates of the present invention is far lighter than conventional lead stereotypes by about thirty-six times: the weight of the former for practical use is usually about 500 grams, whereas that of the latter is about 18 kilograms. A further advantage of the duplicate plates of the present invention is that they can be re-used as the lead plates.

The paper matrix to be employed for this purpose may be prepared by superposing a paper matrix in wet state on an original pattern or a master plate and molding it with elevated pressures to thereby transcribe the pattern in relief on the paper matrix. The molded paper matrix is then subjected to quick drying. The paper matrix is treated to provide a protective layer on the surface thereof in order to prevent a thermoplastic sheet from not releasing out of the matrix on account of the fact that the thermoplastic resin superposed in molten state penetrates into interstices of the paper matrix and solidifies. Materials for providing the matrix surface with the protective layer may be any material that is easily formable in the molding operation prior to molding; that is subsequent to the molding cured sufficiently hard to improve the hardness of the matrix surface; that possesses a good releasability from the duplicate plates which are molded against the matrix; that is stable against heat, particularly in casting lead stereotype thereon, i.e., stable enough not to decompose at temperatures higher than about 220° C because the temperature on the surface of the matrix may amount to higher than said temperature upon casting with lead molten at 300° to 320° C; and that is less permeable against water where polymeric plates having a low hydrophilic property is employed. As one embodiment of the present invention, it has been found that the paper matrix of the present invention on which the protective layer is provided is durable enough for the continuous duplication of at least 40 plates of conventional lead stereotypes against the matrix. This duplication method can be carried out with a conventional caster. The paper matrices which can be used for both plastic and lead printing plates are obtained for the first time by the present invention. The thermoplastic printing plates useful for this purpose may contain a plastic component such as, for example, a homopolymer and copolymer of ethylene or propylene particularly where the 1,2-PBD constituting said plates alone cannot provide a satisfactory high strength and a sufficient elongation for reproducibility and releasability from the matrix. The polymer component having a larger particle size is preferably used, but its size should be appropriate enough not to reduce the viscosity of the plates at molten state to such a level that the surface of the matrix is impaired. The kind and amount of the polymer component may vary depending upon the purpose for use of the plate. For example, a plate produced with a mixture of 1,2-PBD (intrinsic viscosity, 1.34) with polypropylene (melt index, 13) in a ratio of 1,2-PBD to polypropylene of 2:1 can provide a good releasability and a tensile strength of 83.4 kilograms per square cm. The resulting plate does not warp so that the adjustment for a rotary press is rendered very easy and can provide an impression of at least 100,000 copies of publication, per sheet of the said printing plate.

2. Preparation of Duplicate Plates Useful as Flexographic Plates

Unlike newspaper printing plates, flexographic plates require high reproducibility. The duplicate thermoplastic plates according to the present invention are additionally useful as flexographic plates. In this case, it is preferred to use plastic matrices instead of paper matrices. The use of the plastic matrices is particularly useful for this purpose. They can become cured at ambient temperatures by irradiation of actinic light or they can become cured below the heat distortion temperature of the photopolymeric original pattern. This is particularly advantageous because the original pattern is not impaired or damaged and eventually leads to a good reproducibility. Further advantages of the duplicate plates according to the present invention are that they are very easy to dispose of because they decompose in the form of flakes upon exposure of sun light for a certain period of time and generate no noxious fume upon burning. The duplicate plates of the present invention are superior particularly in this respect to plastic printing plates composed of polyvinyl chloride sheet customarily employed for these purposes.

3. Preparation of Duplicate Plates Useful as Building Materials

The duplicate thermoplastic plates in accordance with the present invention may be useful as interior or exterior building materials for decorative purposes, such as artificial wooden plates or precast concrete panels. They may be prepared in the same manner as said flexographic plates. Thus a sheet of plastic matrix according to the present invention is superposed in molten state on an original pattern bearing a desired design pattern in relief and molded with specified pressures. The plastic matrix thus obtained is thus released from the original pattern and worked out in customarily manner. The duplicate plates are prepared by superposing on the said plastic matrix a thermoplastic sheet in molten state and formed by the application of pressure.

The following examples will serve as illustrating the present invention without, however, limiting the same thereto. In examples, "part(s)" means part by weight unless otherwise specified.

EXAMPLE 1

Preparation of Plastic Matrix (1) Resin Compound for Plastic Matrix:

A composition of 100 parts of syndiotactic 1,2-PBD (intrinsic viscosity, 1.34; crystallinity, 25%) and 3 parts of benzoin isopropyl ether were pre-mixed with a universal mixer and mixed with a mixing roll at 120° C. This gave the matrix material.

(2) Preparation of Blank Plastic Matrix:

(a) Said matrix material was molded at a temperature of 120° C and a pressure of 10 kg/cm$^2$ over a period of 30 seconds into a sheet shape with a hydraulic press. At the time of molding, a sheet of releasing paper was placed each on the upper and the lower sides of the molding material with a bearer in 2 mm thick for adjustment of a gap between the upper and the lower platens. After completion of the molding, the material was cooled and the releasing papers were removed giving a sheet having the thickness of 2.0 mm.

(b) Said matrix material was introduced into a plastic extruder set at the barrel temperature of 120° C and extruded from the dies with a gap pre-set at 4.0 mm, giving a sheet having the thickness of 2.0 mm.

(3) Preparation of Plastic Matrix:

(a) In using a photopolymer plate as original pattern:

With a hydraulic molding press, a plastic matrix was prepared from the above sheet. A photopolymer plate of 1 mm thick with a relief pattern having the relief depth of 0.7 mm was used as an original pattern. The plate was laid together with the sheet, and an iron plate having a thickness of 0.3 mm was placed each on the upper and the lower sides of the composite sheet, wherein a bearer in 2 mm thick was used. This composite sheet was subjected to molding at a temperature of 120° C and pressure of 10 kg/cm$^2$ and for 10 seconds. After completion of the molding, the resulting plastic matrix was cooled, released from the photopolymer plate, exposed to a light of a 3 KW high pressure mercury lamp at the distance of 70 cm for 2 minutes, thereby giving a plastic matrix in 1.7 mm thick.

(b) In using wood grain or granite as original pattern:

With a wood grain or granite thin board as the original pattern in place of the photopolymer plate and then processing in a manner similar to (a) above, a photocured plastic matrix was obtained.

The plastic matrix obtained by (a) or (b) can be molded into a pre-cast concrete panel having a relief pattern either by contacting with the molten resin material under pressure or by pre-fixing it to the concrete panel and pouring the cement therein.

EXAMPLE 2

Preparation of Plastic Matrix

A mixture of 100 parts of the syndiotactic 1,2-PBD used in Example 1 and 100 parts of silica ("Crystallite A-1", trade mark of Shiraishi Calcium K.K.) were premixed with a universal mixer and then mixed with a mixing roll at 120° C. By adding 4 parts of benzoin n-butyl ether to the mixture and mixing them with the mixing roll at 120° C, a matrix material was obtained. By treating the thus obtained matrix material in accordance with the method described in Example 1 (2) and (3), a plastic matrix was prepared.

EXAMPLE 3

The matrix materials prepared under Example 1 and Example 2 were applied to the extruder which was set at the barrel temperature of 120° C and the gap of dies at 0.1 mm, and the hot pad of said material was laminated on a paper composite sheet provided at the lower part of the dies. Then, the set materials were let through the calender roll and subjected simultaneously to cooling and lamination, by which the laminated paper composite sheet was obtained. On the face of the obtained sheet, a photopolymer plate, metal engraving, or type form was laid as original, and the layer was applied to the cylindrical press for molding in a conventional method. After molding, the product was exposed to a light of a high voltage mercury lamp (3 KW) at the distance of 70 cm for 2 minutes, and a light-hardened matrix was obtained. This matrix showed no change after 30 times' repeated preparation of duplicates with the use of the thermoplastic resin sheet shown in Example 6 (1)–(3).

EXAMPLE 4

| | |
|---|---|
| Syndiotactic 1,2-PBD | 100 parts |

-continued

| | |
|---|---|
| ([η]=1.34, crystallinity 25 %) | |
| Benzoin isopropyl ether | 50 parts |
| Xylene | 500 parts |

The solution obtained by mixing the above 3 components (viscosity, 1,600 centipoise at 25° C) was applied to a paper composite sheet in the coating amount of 2 mg/cm$^2$ and the resultant was allowed to stand at an ambient temperature for 2 hours to obtain the coated paper matrix.

With the use of the obtained sheet, molding was effected as in Example 3 and a light was applied to obtain the light-hardened matrix.

This matrix showed no change after 30 times' repeated preparation of duplicates with the use of the thermoplastic resin sheet shown in Example 6 (1)–(3).

EXAMPLE 5

Preparation of Thermoplastic Resin Sheet for Plastic Duplicate

| | |
|---|---|
| (1) Syndiotactic 1,2-PBD ([η]=1.34, crystallinity 25 %) | 100 parts |
| Polypropylene (melt index 13) | 50 parts |

After subjecting the above 2 components to premixing, they were applied to the extruder to prepare a sheet of 2 mm thick. The molding conditions employed were as noted below:

Barrel section 190° C, head section 190° C, die section 175° C, and nip 4.0 mm

| | |
|---|---|
| (2) Syndiotactic 1,2-PBD ([η]=1.34, crystallinity 25 %) | 100 parts |
| polypropylene (melt index 13) | 50 parts |
| Silica (trade name: "Crystallite A-1", made by Shiraishi Calcium K.K.) | 20 parts |

After subjecting the above 3 components to premixing, they were molded by extruder as in the case of the Example 6 (1) to prepare a sheet of 2.0 mm thick.

| | |
|---|---|
| (3) Syndiotactic 1,2-PBD ([η]=1.34, crystallinity 25 %) | 100 parts |
| Silica (trade name: "Crystallite A-1", made by Shiraishi Calcium K.K.) | 20 parts |

After subjecting the above 2 components to premixing, they were extruded for molding to prepare a sheet of 2.0 mm thick. With the addition of 2.0 parts of carbon black besides silica, a sheet can be similarly prepared. The molding conditions employed were as noted below:

Barrel section 135° C, head section 133° C, die section 135° C, and nip 4.0 mm.

EXAMPLE 6

Method of Preparation of Plastic Duplicate (1) Molding by hydraulic press:

The molten thermoplastic resin sheet (Example 6 (1)–(3)) and the plastic matrix (Example 1 and Example 2) were laid together between the platens and were subjected to pressure under 10 kg/cm$^2$ for 10 seconds, after which they were cooled down and the matrix and the said resin sheet were detached to obtain a plastic duplicate.

In 500 times' duplication, the relief reproduction fidelity of the duplicate showed no degradation at all.

(2) Molding by calender molding:

With the device shown in the drawing, a plastic duplicate was prepared. In the said device, the heating unit 4 is designed to give heat by means of the hot air circulation system controlled to the fixed temperature (shown in Table 1) within the allowance of ±2° C.

Table 1

| Kind of thermoplastic resin sheet | Ambient temperature of heater (° C) |
|---|---|
| Example 5 (1) | 160 |
| Example 5 (2) | 160 |
| Example 5 (3) | 120 |
| Polyethylene (melt index 50) | 120 |
| Polyethylene (melt index 50) + carbon black* | 110 |
| Polypropylene (melt index 7) | 200 |
| Polypropylene (melt index 7) + carbon black* | 200 |

*mixing method is same as in Example 5 (2).

The carrying speed of the conveyor should be determined by experiment, which should desirably be, for example, 1.5–3.0 m/min. When the transfer is made at this speed, a plastic duplicate having good printability is obtainable. The nip between the cylinders should be kept at 3.8 mm. When the matrix thickness is set at 1 mm, the thickness of thermoplastic resin sheet at 2 mm, and the thickness of steel belt at 1 mm, the matrix and the plastic duplicate delivered from the cylinder nip have already been cooled down by the cylinder through which the state readily detachable one another, but by giving additional cooling they are completely separated. The temperature of the cooling water to be let to the rolls 5, 6 and the cooling roll 8 should desirably be in the range of 5°–10° C. For cooling the circulating water, an ordinary cooler or electronic cooler can be used.

(3) Molding by injection molding:

By applying the matrix (of Example 3, and 4) to the injection die and injecting to the matrix the pre-mixed thermoplastic resin mixture shown in Example 5, a plastic duplicate can be prepared. The obtained plastic duplicate is usable as printing plate on application to the rotary press. At least 3 duplicates are producible in a minute.

The injection pressure desirable is 5–20 kg/cm$^2$.

What is claimed is:

1. A duplicate thermoplastic printing plate bearing a printing relief pattern theron, said printing plate comprising a sheet having a thickness of 1.0 to 10 mm, said sheet comprising syndiotactic 1,2-polybutadiene having a crystallinity of approximately 10 to 30% and an intrinsic viscosity of greater than approximately 0.7 when measured in toluene at 30° C.

2. The duplicate thermoplastic printing plate according to claim 1 wherein said syndiotactic 1,2-polybutadiene has an intrinsic viscosity of from about 1.0 to 2.5 when measured in toluene at 30° C.

3. The duplicate thermoplastic printing plate according to claim 1 including an admixture of a thermoplastic resin with said syndiotactic 1,2-polybutadiene.

4. The duplicate thermoplastic plate according to claim 3, wherein said thermoplastic resin used in admixture with the syndiotactic 1,2-polybutadiene is a member selected from the group consisting of a homopolymer or copolymer of ethylene or propylene, polycarbonates, ABS resins and polyvinyl chloride and has a melt index of from about 3 to 400 and is used in amount of from about 1 to 500 parts by weight with respect to 100 parts by weight of said syndiotactic 1,2-polybutadiene.

5. A crosslinked matrix suitable for the manufacture of a duplicate thermoplastic printing plate, said plastic matrix having a thickness of 1 to 10 mm and comprising syndiotactic 1,2-polybutadiene having a crystallinity of approximately 10 to 30% and an intrinsic viscosity of greater than approximately 0.7 when measured in toluene at 30° C; and a curing catalyst dispersed in said syndiotactic 1,2-polybutadiene.

6. The plastic matrix according to claim 5, wherein said catalyst is a member selected from the group consisting of a photoinitiator and a thermally curable substance.

7. The plastic matrix according to claim 6, wherein the photoinitiator is a member selected from the group consisting of 5-nitroacenaphthene, anthracene, p-dinitrobenzene, m-dinitrobenzene, 2-chloro-4-nitroaniline, 9-anthranyl aldehyde, benzophenone, benzil, p,p'-tetramethyl diaminobenzophenone, benzanthrone, 1,2-benzanthraquinone, 1,2-naphthoquinone, 1,4-naphthoquinone, benzoin, benzoin methyl ether, benzoin isopropyl ether and benzoin n-butyl ether.

8. The plastic matrix according to claim 6, wherein said thermally curable substance is a member selected from the group consisting of dicumyl peroxide, 2,5-dimethyl-2,5-di-tert-butyl peroxyhexane, 2,5-dimethyl-2,5-di-tert-butyl peroxyhexene-3, di-tert-butyl hydroperoxide and cumenyl hydroperoxide.

9. The plastic matrix according to claim 5, wherein said catalyst is used in an amount of from about 0.01 to 10 parts by weight per 100 parts by weight of said syndiotactic 1,2-polybutadiene.

10. The plastic matrix according to claim 9, wherein said catalyst is used in an amount of from about 0.05 to 5.0 parts by weight per 100 parts by weight of said syndiotactic 1,2-polybutadiene.

11. A modified paper matrix suitable for the manufacture of a duplicate thermoplastic printing plate, comprising a paper substrate and bonded to said substrate a layer of crosslinked syndiotactic 1,2-polybutadiene having a crystallinity of approximtely 10 to 30% and an intrinsic viscosity of greater than approximately 0.7 when measured in toluene at 30° C, said layer having a thickness of from about 0.01 to 0.1 mm.

* * * * *